US012302943B1

(12) United States Patent
Wang et al.

(10) Patent No.: US 12,302,943 B1
(45) Date of Patent: May 20, 2025

(54) ELECTRONIC CIGARETTE WITH ADJUSTABLE FLAVORS

(71) Applicant: Shenzhen Daosen Science and Technology Co., Ltd, Shenzhen (CN)

(72) Inventors: Zhuofan Wang, Shenzhen (CN); Lang Ren, Shenzhen (CN)

( * ) Notice: Subject to any disclaimer, the term of this patent is extended or adjusted under 35 U.S.C. 154(b) by 0 days.

(21) Appl. No.: 18/672,030

(22) Filed: May 23, 2024

(30) Foreign Application Priority Data

Jan. 15, 2024 (CN) ..... 202420092908.9

(51) Int. Cl.

| | |
|---|---|
| ***A24F 13/00*** | (2006.01) |
| ***A24F 40/30*** | (2020.01) |
| ***A24F 40/50*** | (2020.01) |
| ***A24F 40/60*** | (2020.01) |
| ***A24F 40/90*** | (2020.01) |
| *A24F 40/10* | (2020.01) |

(52) U.S. Cl.
CPC ..... *A24F 40/30* (2020.01); *A24F 40/50* (2020.01); *A24F 40/60* (2020.01); *A24F 40/90* (2020.01); *A24F 40/10* (2020.01)

(58) Field of Classification Search
CPC ..... A24F 47/00
USPC ..... 131/328–329
See application file for complete search history.

(56) References Cited

U.S. PATENT DOCUMENTS

2019/0124982 A1* 5/2019 Atkins ..... A61M 11/042
2023/0309618 A1* 10/2023 Crowe ..... A24F 40/46 131/329

* cited by examiner

*Primary Examiner* — Phuong K Dinh

(57) ABSTRACT

An electronic cigarette with adjustable flavors, containing a first atomizing core, a second atomizing core, and a control circuit structure; the first atomizing core is provided with a first smoke outlet channel, and the second atomizing core is provided with a second smoke outlet channel; the first smoke outlet channel is connected to the second smoke outlet channel in series; the control circuit structure selectively activates operation of the first atomizing core and/or the second atomizing core.

3 Claims, 1 Drawing Sheet

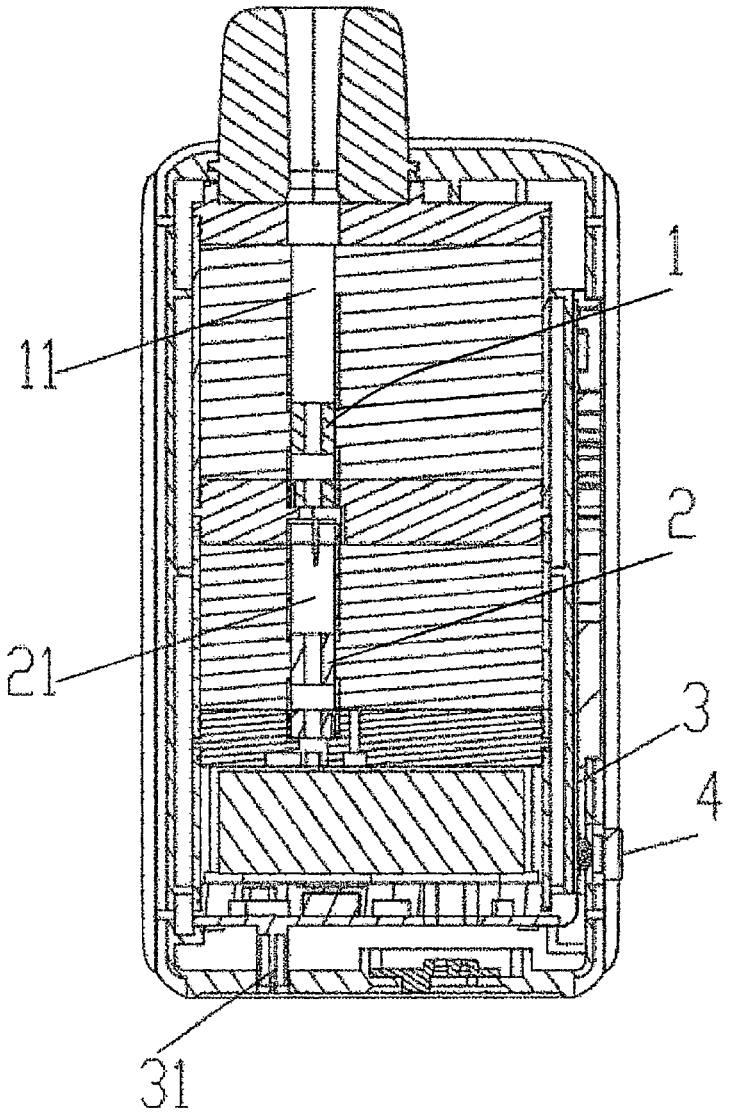
1
11
2
21
3
4
31

ELECTRONIC CIGARETTE WITH ADJUSTABLE FLAVORS

BACKGROUND OF THE INVENTION

The present invention relates to an electronic cigarette with adjustable flavors.

Smoking is harmful to health and may lead to severe respiratory diseases and cancers. However, it is very difficult for smokers to completely abstain from smoking. The active ingredient in cigarettes is nicotine. When smoking, nicotine enters the alveoli and is absorbed by the body together with a large amount of atomized tar generated during combustion of the cigarettes. After nicotine is absorbed into the blood, it acts on receptors of the central nervous system, causing euphoric feeling similar to that caused by stimulants. Not only will conventional cigarettes harm smokers, but it has also been proven that non-smokers are even more seriously harmed by passive smoking. In order to reduce the harms of conventional cigarettes to human body, a substitute for conventional cigarettes has emerged on the market, known as electronic cigarettes. Electronic cigarettes, also known as simulated cigarettes, electronic vaporizers, or electronic cigars, have a similar appearance to conventional cigarettes and a taste that resembles conventional cigarettes. Electronic cigarettes are mainly used to simulate the sensation of smoking without affecting health, serving as a tool for smoking cessation or as a substitute for conventional cigarettes.

However, existing electronic cigarette vaporizers usually only have one flavor, resulting in a less satisfying experience for users.

BRIEF SUMMARY OF THE INVENTION

In view of the aforesaid disadvantages now present in the prior art, the present invention provides an electronic cigarette with adjustable flavors, achieved through the following technical proposal:

An electronic cigarette with adjustable flavors, comprising a first atomizing core, a second atomizing core, and a control circuit structure; the first atomizing core is provided with a first smoke outlet channel, and the second atomizing core is provided with a second smoke outlet channel; the first smoke outlet channel is connected to the second smoke outlet channel in series; the control circuit structure selectively activates operation of the first atomizing core and/or the second atomizing core.

Further, a switch button is provided on the electronic cigarette to trigger an operation of the control circuit structure.

Further, the control circuit structure is connected to a charging port configured to recharge the electronic cigarette.

The present invention has the following beneficial effects: the first atomizing core and the second atomizing core can be loaded with different flavored e-liquids. When the control circuit structure selectively activates the first atomizing core but not the second atomizing core to operate, the flavor of the e-liquid in the first atomizing core is presented. When the control circuit selectively activates the second atomizing core but not the first atomizing core to operate, the flavor of the e-liquid in the second atomizing core is presented. When the control circuit structure selectively activates both the first atomizing core and the second atomizing core to operate, a mixed flavor is presented, and since the smoke outlet channels of the first atomizing core and the second atomizing core are connected in series, two different flavors of e-liquids in the first atomizing core and the second atomizing core can be thoroughly mixed when the smoker inhales.

BRIEF DESCRIPTION OF THE DRAWINGS

FIG. 1 illustrates a structure of the electronic cigarette according to the present invention.

DETAILED DESCRIPTION OF THE INVENTION

The following is a further description of the present invention with reference to exemplary embodiments. The disclosed embodiments are only some but not all of the embodiments of the present invention, and they are provided for the purpose of illustrating the present invention and do not limit the scope of the present invention.

As shown in FIG. 1, an electronic cigarette with adjustable flavors is provided, comprising a first atomizing core 1, a second atomizing core 2, and a control circuit structure 3; the first atomizing core 1 is provided with a first smoke outlet channel 11, and the second atomizing core 2 is provided with a second smoke outlet channel 21; the first smoke outlet channel 11 is connected to the second smoke outlet channel 21 in series; the control circuit structure 3 selectively activates operation of the first atomizing core 1 and/or the second atomizing core 2. The control circuit structure 3 used herein is a prior art, which can be the circuit structure for electronic cigarette disclosed in CN219699054U.

The first atomizing core 1 and the second atomizing core 2 can be loaded with different flavored e-liquids. When the control circuit structure selectively activates the first atomizing core 1 but not the second atomizing core 2 to operate, the flavor of the e-liquid in the first atomizing core 1 is presented. When the control circuit selectively activates the second atomizing core 2 but not the first atomizing core 1 to operate, the flavor of the e-liquid in the second atomizing core 2 is presented. When the control circuit structure selectively activates both the first atomizing core 1 and the second atomizing core 2 to operate, a mixed flavor is presented, and since the smoke outlet channels of the first atomizing core 1 and the second atomizing core 2 are connected in series, two different flavors of e-liquids in the first atomizing core 1 and the second atomizing core 2 can be thoroughly mixed when the smoker inhales.

In a further aspect of the present invention, operation of the control circuit structure 3 is triggered by a switch button 4.

In a further aspect of the present invention, the control circuit structure 3 is connected to a charging port 31 configured to recharge the electronic cigarette.

The above description is merely an exemplary embodiment of the present invention and does not impose any limitations on the present invention. Although the present invention has been disclosed with the exemplary embodiment mentioned above, it is not intended to limit the present invention. Any other embodiments with equivalent technical effects through alternative configurations based on slight modifications or variations of the present invention made by those skilled in the art within the technical scope of the present invention and in accordance with the teachings of the present invention as disclosed above, are still within the scope of the present invention.

What is claimed is:

1. An electronic cigarette with adjustable flavors, comprising a first atomizing core, a second atomizing core, and a control circuit structure; wherein a first smoke outlet channel is partially defined in the first atomizing core and is configured for airflow to pass through, and a second smoke outlet channel is partially defined in the second atomizing core and is configured for airflow to pass through; the first smoke outlet channel is in communication with the second smoke outlet channel in series; and the control circuit structure is configured to selectively activates operation of the first atomizing core and/or the second atomizing core;

in a horizontal direction, a width of the first atomizing core is equal to a maximum width of the first smoke outlet channel, and a width of the second atomizing core is equal to a maximum width of the second smoke outlet channel; and the first atomizing core and the first smoke outlet channel are arranged in a same direction, and the second atomizing core and the second smoke outlet channel are arranged in the same direction.

2. The electronic cigarette with adjustable flavors of claim 1, wherein a switch button is provided on the electronic cigarette to trigger an operation of the control circuit structure.

3. The electronic cigarette with adjustable flavors of claim 1, wherein the control circuit structure is connected to a charging port configured to recharge the electronic cigarette.

* * * * *